US005278367A

United States Patent [19]

Homol

[11] Patent Number: 5,278,367

[45] Date of Patent: Jan. 11, 1994

[54] HIGH PRESSURE RESPONSIVE SWITCH AND METHOD FOR MAKING SAME

[75] Inventor: Stanley G. Homol, Taunton, Mass.

[73] Assignee: Texas Instruments Incorporated, Dallas, Tex.

[21] Appl. No.: 987,522

[22] Filed: Dec. 8, 1992

[51] Int. Cl.[5] ..... H01H 35/34

[52] U.S. Cl. ..... 200/83 J; 200/82 R; 200/83 P; 200/302.1

[58] Field of Search ..... 92/98; 73/723, 745; 340/626; 307/118; 200/302.1, 306, 82

[56] References Cited

U.S. PATENT DOCUMENTS

| | | | |
|---|---|---|---|
| 3,616,114 | 10/1986 | Strasser | 200/83 J |
| 4,495,389 | 1/1985 | Place | 200/83 P |
| 4,794,214 | 12/1988 | Sanford | 200/83 S |
| 4,853,504 | 8/1989 | Tanaka | 200/83 J |
| 5,149,927 | 9/1992 | Stahly | 200/83 P |

FOREIGN PATENT DOCUMENTS

| | | | |
|---|---|---|---|
| 819191 | 10/1937 | France | 200/83 J |
| 1097930 | 1/1968 | United Kingdom | 200/83 J |

*Primary Examiner*—Gerald P. Tolin

*Attorney, Agent, or Firm*—Russell E. Baumann; Richard L. Donaldson; Rene' E. Grossman

[57] ABSTRACT

A pressure responsive switch is shown having an electrically conductive body 12 formed with a bore 24 which extends from one side through the body into recess 30 formed in the opposite side of the body. A switch assembly 34 is received and locked in the recess by crimping downwardly extending wall 32 of the body over the assembly. The switch assembly has a terminal 35 formed with a stationary contact 36 on an end thereof mounted electrically isolated from an annular disc seat member 40 which in turn receives an electrically conductive disc member 56 and a flexible diaphragm 60. An elongated piston 64 is receivable in a port 18 of a pump and is slidably received in bore 24 of body 12 with an end 70 placed contiguous to the diaphragm 60 and center of the disc member 56. A piston retainer ring 68 is disposed on piston 64 adjacent end 70 and located so that a selected preload is placed on the switch assembly which in turn maintains the piston 64 in a vertical orientation relative to a retainer shelf 66 against which the retainer ring reacts.

6 Claims, 2 Drawing Sheets

HIGH PRESSURE RESPONSIVE SWITCH AND METHOD FOR MAKING SAME

This invention relates generally to pressure responsive electrical switches and more particularly to such switches intended for use with a relatively high fluid pressure source such as those employed in automotive power steering systems.

In order to improve economy by conserving fuel it is conventional to set the idle speed of engines to a low level sufficient to generate torque to keep the engine running but insufficient to meet additional demands of power steering required, for example, for making a turn from a stopped position while parking or at a traffic light. It is also conventional to place a pressure responsive switch in communication with the hydraulic fluid of the system in order to provide a signal to the powertrain control module (PCM) responsive to the power steering demand so that engine speed can be increased when required to prevent stalling.

A prior art switch used for this purpose is mounted in a power steering fluid pump and includes a piston slidable disposed in a port which extends from the high pressure side of the pump. A stationary electrical contact is disposed in alignment with the piston in a switch chamber and a second electrical contact is mounted on the end of the piston adjacent the stationary electrical contact. The piston is normally biased away from the second electrical contact and is adapted to move into engagement with the stationary contact when the pressure of the fluid increases to a certain level. The fluid not only communicates with the piston but it also is received in the switch chamber so that the contacts move into and out of engagement submersed in the fluid.

This prior art switch suffers from several limitations. Over time dirt and contaminants in the fluid tend to get between the contacts and interfere with the electrical switching when the contacts come into engagement. Further, the particular pressure level at which switching occurs tends to change over the life of the device due to friction of the piston in the port making it difficult to maintain adequate control of the actuation pressure level. Still another problem is the low level of contact force at pressures close to the actuation pressure.

It is therefore, an object of the invention to provide a pressure responsive electrical switch useful with power steering fluids free of the above noted prior art limitations. Yet another object of the invention is the provision of a pressure responsive switch having a long life, on the order of a million cycles or more, with minimal change in its effective calibration. Another object of the invention is the provision of a pressure responsive switch which can be mounted in various orientations, one which is relatively inexpensive yet rugged and reliable.

Briefly, in accordance with the invention, a piston slidably received in a port formed in the power steering fluid pump extends into a switch body and has an end disposed adjacent to a switch assembly comprising a current carrying disc movable between opposed dished configurations. The disc is preferably snap acting and is selected to move from one dished configuration to an opposite dished configuration when subjected to a preselected actuation force. The disc is mounted on an annular disc seat and a stationary electrical contact is placed in alignment with the center of the disc and located at a selected location within the movement of the disc with the disc providing a selected level of contact force. According to a feature of the invention a diaphragm disposed between the piston and the disc is formed with a central portion displaced from the plane in which the remainder of the diaphragm lies in order to facilitate axial movement of the piston and transfer of force to the disc and minimize calibration shift with changes in temperature. According to another feature of the invention a retainer seat is formed in the switch body adjacent to the diaphragm and in communication with a bore through which the piston extends. A retainer ring is placed on the piston adjacent an end thereof at a location which results in a force being placed on the piston by the diaphragm. This force, in conjunction with the retainer ring which is received on the retainer seat, maintains the piston in a vertical but floating orientation relative to the retainer seat so that the piston is guided solely by the port of the pump in which its other end is received. The disc is chosen having a selected actuation force and release force characteristics. The actuation force may then be calibrated by the preload of the piston.

That is, the preload decreases the actuation force level but does not affect the release force level of the switch. The switch chamber is sealed using flexible O-rings between the diaphragm and switch body as well as between the disc seat member and the stationary contact mounting member. The switch assembly, including the stationary contact mounted on a terminal disposed in an electrically insulative eyelet member, the disc seat member, disc and diaphragm are telescopically received in a cylindrical opening formed in the body which is then crimped over to lock the switch assembly to the body with the current path extending from the terminal through the disc when in the actuated position through the disc seat member and through the body to the pump housing. According to a feature of the invention the specific location of the stationary contact relative to the plane in which the disc seat lies is adjusted by deforming the top surface of the contact to a desired location providing a selected release force for snapping of the disc back to its at rest configuration.

Various other objects and advantages of the invention will appear from the following description of an embodiment of the invention and the novel features and methods of making the switch of the invention will be particularly pointed out hereinafter in connection with the accompanying drawings and appended claims.

Figure 1:
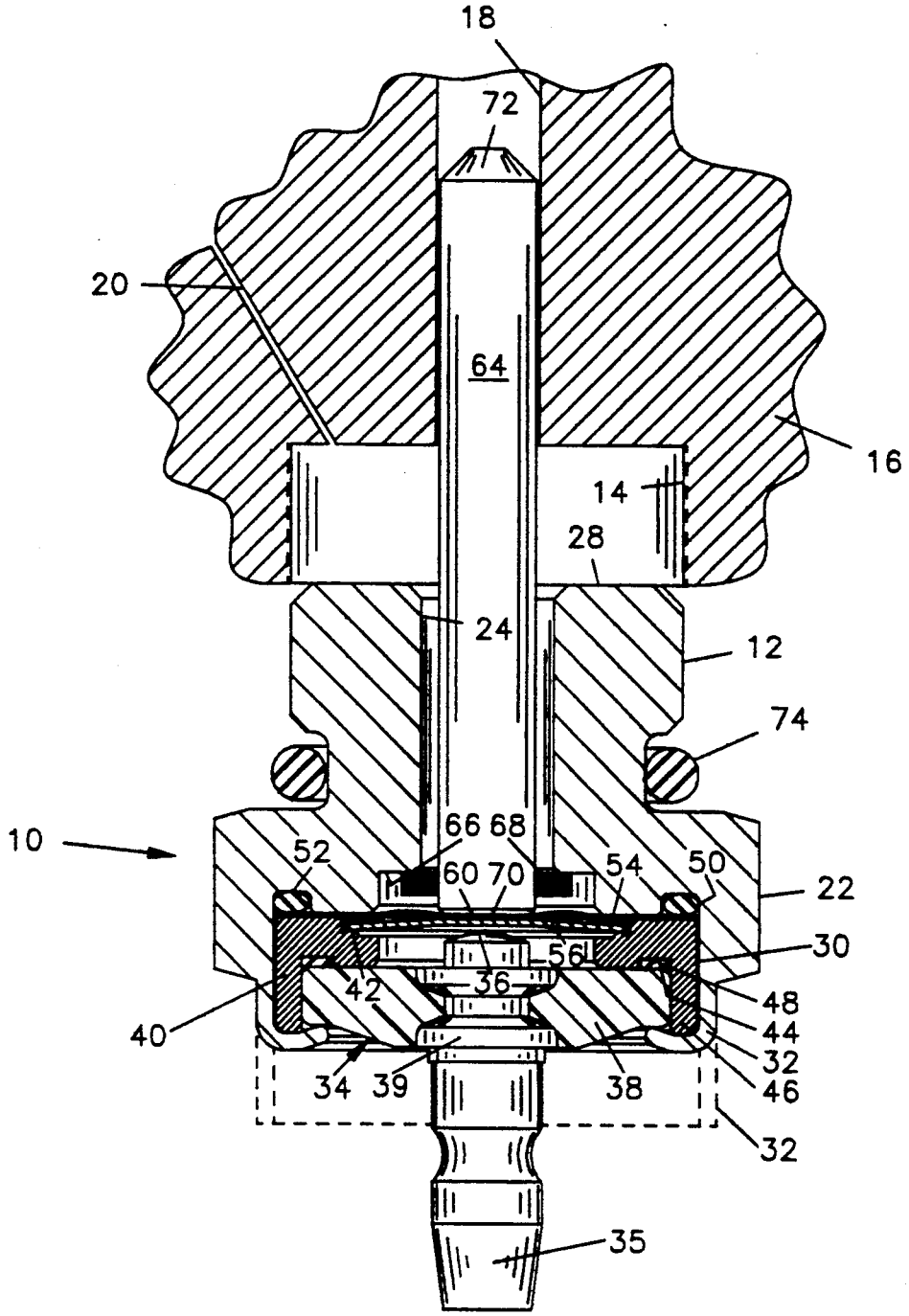
FIG. 1 of the drawings is a cross sectional view taken through a switch made in accordance with the invention shown in alignment with a switch seat formed in the housing of a power steering system fluid pump and with a pressure converter piston of the switch received in a port of the pump communicating with the high pressure side of the pump.

In the illustrated embodiment, hydraulic pressure switch 10 comprises a generally cylindrical body 12 preferably having a male thread thereon formed of suitable electrically conductive material such as brass having an outer diameter suitable for reception in a mating threaded switch seat 14 formed in the housing 16 of a power steering fluid pump (not shown). A port 18 is formed in housing 16 communicating with the high pressure side of the pump and a vent passage 20 extends from seat 14 to the suction side of the pump.

A hexagonal section 22 is formed on body 12 to facilitate installation of the switch in seat 14. A bore 24 extends from a top surface portion 28 to a recess 30 formed in the bottom portion of body 12. A wall portion 32 extends downwardly from recess 30 and is adapted to be crimped over to lock a switch assembly placed in the recess to be described below.

Switch assembly 34 comprises a centrally disposed elongated terminal 35 of brass or other suitable electrically conductive material formed with a stationary electrical contact 36 on the inner distal end thereof. Terminal 35 is mounted in an eyelet 38 formed of suitable electrically insulative material, preferably a moldable material, such as a conventional phenolic. Eyelet 38, in turn is received on a disc seat member 40, a generally annular member having a disc seat 42 formed in the top portion thereof, and an O-ring seat 44 in the bottom portion thereof adjacent a downwardly extending wall portion 46. An O-ring 48 composed of suitable flexible material is disposed in O-ring seat 44 and the parts are joined together to form a unitary body. An alternate method would be to mold terminal 35, eyelet 38 and disc seat member 46 in a single molding operation, eliminating the need for seal member 48 and forming a unitary body by double insert molding. Terminal 35 may be formed with a knurl portion at 39 to improve the bond between the terminal and the electrically insulative eyelet 38.

A second O-ring seat 50 is formed in base 12 in communication with recess 30 which receives O-ring 52 similar to O-ring 48. Recess 30 is formed with an end surface 54 inbound of O-ring seat 50 which is preferably tapered slightly to provide a larger central opening, or switching chamber, to facilitate the motion of a switch member 56 to be discussed below. Switch member 56 is an electrically conductive disc member received on seat 42 and is adapted to move, preferably with snap action, between oppositely dished configurations in and out of engagement with stationary contact 36. When disc member 56 is in engagement with contact 36, an electrical path exists from terminal 35 through contact 36, disc member 56, disc seat member 40, body 12 and pump housing 16 which is grounded. When disc member 56 moves to its opposite dished configuration as shown in FIG. 1 the electrical path is opened. If desired, disc member 56 can be coated with gold on its lower surface to provide an optimum low resistance path between the disc seat member and the stationary contact. The disc is chosen so that it will move from an at rest, first dished configuration to an opposite dished configuration when subjected to a selected actuation force and will return to its original, at rest dished configuration when the force level decreases to a selected, lower force level, as shown in the Force vs. Deflection curve of FIG. 3.

Figure 2:
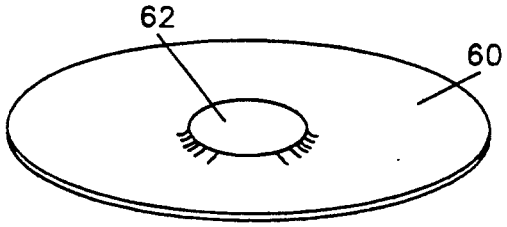
FIG. 2 is a perspective view of a diaphragm used in the FIG. 1 switch.

A flexible diaphragm 60, see also FIG. 2, is disposed between switch assembly 34 and end wall 54 of recess 30. Flexible diaphragm 60 composed of Kapton or similar suitable material is preferably formed with a central portion 62 permanently deformed, or preformed, a distance of up to approximately 0.02 inches out of the plane in which the remainder of the diaphragm lies. The central portion 62 preferably extends upwardly as seen in FIG. 1 and may extend over an area comparable to the size of piston 64 to be discussed below, which allows unfettered movement of the central portion 62 even though diaphragm 60 is held tautly between recess surface 54 and switch assembly 34 while still effectively serving to seal the switch chamber from the power steering fluid.

A recessed retainer shelf 66 is formed in bottom wall 54 and is in communication with bore 24. A retainer ring 68 composed of brass, or other suitable material, is placed on piston 64 formed of suitable material such as stainless steel, adjacent its lower end 70 with an interference fit for a purpose to be described infra. Piston 64 is closely and slidably received in port 18, with top end 72 in communication with high pressure fluid in the pump when switch body 12 is placed in seat 14. An O-ring 74 provides a seal for the switch. Fluid which flows between port 18 and piston 64 is allowed to return to the sump via vent 20.

Clearance between piston 64 and port 18 is on the order of 0.0008–0.002 inches whereas bore 24 is formed so that there is on the order of 0.015–0.020 inches clearance. Port 18 serves to guide the pin with bore 24 being large enough that piston 64 can float within the bore. In order to prevent any skewing motion of piston 64, which could cause engagement with the sidewall of bore 24 and consequent friction, wear and interference with operation of the switch, the retainer ring 68 is located on the piston such that it is in intimate contact with and preferably is preload against the disc. This adjustment helps to maintain the piston in a vertical orientation relative to shelf 66. Initially, retainer ring 68 is placed on piston 64 so that end 70 projects beyond end wall 54 a distance greater than desired. The piston is then pushed back toward the top of body 12 so that retainer ring is forced to move toward end 70 until a selected distance exists between end 70 and a plane in which disc seat 42 lies when switch assembly 34 is inserted in recess 30. Provision of the preload also helps to reduce variability in the calibration set points of the switch.

In assembling the switch a disc member 56 is placed on the disc seat and diaphragm 60 is placed on top of the disc member. The switch assembly is then pushed into the recess 30 and downwardly depending wall 32 is bent over from the dashed line position shown in FIG. 1 to the solid line position to provide a compressive force on O-rings 48, 52 and diaphragm. 60 as well as to ensure an effective electrical connection between disc seat member 40 and body 12. It will be noted that disc seat member 30, clamped by the crimp of wall 32, is designed in such a way as to contain system pressure under unusual high pressure or high temperature conditions thereby minimizing the force applied to eyelet 38 through terminal 35.

Calibration of the switch is effected by choosing a snap acting disc having a desired actuation force level in combination with the specific preload employed on piston 64. The preload correlates to the specific distance that end 70 extends beyond the point at which it just touches the center of or uppermost portion of the disc (through the diaphragm 60) without placing any load on the disc. The preload will decrease the amount of force required to actuate the disc and, since it does not affect the release force of the disc, reduces the hysteresis or differential between contact engagement force level and contact disengagement (release) force level. The release or contact disengagement force level can be adjusted by the vertical placement of stationary contact 36 within the region a-b noted in FIG. 3, the Force vs Deflection curve of the center of a free disc member. The precise location can be modified, as depicted in FIG. 4, by deforming the contact to the specific height desired as by use of ram 74 having a bottom surface, preferably curved with a diameter greater than the diameter of stationary contact 36.

Figure 3:
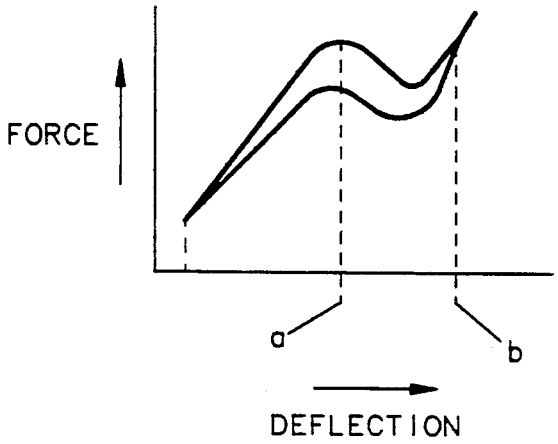
FIG.3 is a Force vs Deflection curve of a free disc used in the FIG. 1 switch.
Figure 4:
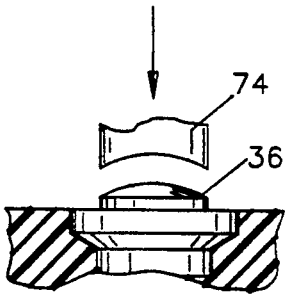
FIG. 4 is a broken away view of a ram used to adjust the height of the stationary contact of the FIG. 1 switch.

Typically a disc used in the switch assembly has a deflection on the order of 0.007 inches between points a and b of the FIG. 3 curve. An actuation force is on the order of six pounds with a differential between actuation and release forces on the order of a half to one pound. The preload typically is on the order correlating to 0.001–0.003 inches which is on the order of a pound or less.

The switch of the invention senses high side system pressure, e.g., on the order of 1500 psi, and allows high pressure fluid to throttle pass the piston to the low pressure side thereby allowing the use of a low pressure diaphragm to prevent the fluid from entering the contact area of the switch. Although the switch described above is normally open, it will be understood that a switch made in accordance with the invention could be normally closed as well by providing conventional motion transfer members and could have multiple throw constructions as well as the single throw shown. Further, it is within the purview of the invention to have the switching circuit electrically isolated from the body as well as the structure shown in which the electrical circuit is completed to ground through the switch body.

It will be understood that various changes in the details, materials, arrangement of parts and steps of assembly and calibration which have been illustrated in order to explain the nature of the invention, may be made by those skilled in the art within the principle and scope of the invention, as expressed in the appended claims.

I claim:

1. A pressure responsive electrical switch for use with a high fluid pressure source comprising:

a body portion having a top and bottom surface and having a generally cylindrical recess with an end wall formed in the bottom surface, a switch assembly comprising a generally annular disc seat member having a disc seat, a terminal member centrally mounted within the annular disc seat and electrically isolated therefrom by an eyelet of electrically insulative material, the terminal having a stationary contact portion received in the recess, an electrically conductive disc member disposed on the disc seat overlying the stationary contact portion and being movable into and out of engagement with the stationary contact portion, a flexible diaphragm received over the disc and disc seat, the switch assembly received in and closing the recess, the body having a bore extending from the top surface to the recess, a retainer shelf formed in the end wall in communication with the bore, an elongated piston member having first and second ends slidably received in the bore, the piston member having an outer periphery smaller than that of the bore so that it can be spaced therefrom, a retainer element adjustably mounted adjacent the first end of the piston member received on the retainer shelf with the first end of the piston member biased against the switch assembly so that the piston member is maintained in a fixed orientation with the retainer element biased against the retainer shelf, the second end of the piston member adapted to be placed in communication with a fluid pressure source and means to form a current path from the terminal through the disc and disc seat member.

2. A pressure responsive electric switch according to claim 1 in which the disc member is snap acting.

3. A pressure responsive electric switch according to claim 1 in which the body is formed with a wall member extending downwardly from the recess and the wall member is crimped over the switch assembly locking it within the recess.

4. A pressure responsive electric switch according to claim 1 in which the body is formed of electrically conductive material and the current path extends from the disc seat member through the body.

5. A pressure responsive electric switch according to claim 1 in which a first O-ring is placed between the body and the diaphragm and a second O-ring is placed between the disc seat member and the eyelet of electrically insulating material.

6. A pressure responsive electric switch according to claim 1 in which the diaphragm has a portion aligned with the piston member which is deformed out of a plane in which the remainder of the diaphragm lies.

* * * * *